US006485896B2

(12) United States Patent
Greener et al.

(10) Patent No.: US 6,485,896 B2
(45) Date of Patent: Nov. 26, 2002

(54) EMULSION COMPOSITION TO CONTROL FILM CORE-SET

(75) Inventors: Jehuda Greener, Rochester, NY (US); Yongcai Wang, Webster, NY (US); Gary W. Visconte, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/731,271

(22) Filed: Dec. 6, 2000

(65) Prior Publication Data

US 2002/0098452 A1 Jul. 25, 2002

(51) Int. Cl.[7] ..... G03C 1/31; G03C 1/91; G03C 1/93; G03C 1/795; G03C 11/22

(52) U.S. Cl. ..... 430/349; 430/523; 430/531; 430/533; 430/539; 430/637; 430/638; 430/639; 430/640; 430/930; 427/316; 427/393.5

(58) Field of Search ..... 430/349, 533, 430/637, 638, 640, 930, 523, 531, 639, 539; 427/316, 393.5

(56) References Cited

U.S. PATENT DOCUMENTS

| | | | | | |
|---|---|---|---|---|---|
| 3,782,947 | A | | 1/1974 | Kraull | |
| 3,806,574 | A | | 4/1974 | Arvidson, Jr. | |
| 3,916,022 | A | | 10/1975 | Potter | |
| 3,988,157 | A | * | 10/1976 | Van Paesschen et al. | 430/539 |
| 4,141,735 | A | | 2/1979 | Schrader | 430/533 |
| 4,279,975 | A | | 7/1981 | Bowsky | |
| 4,808,363 | A | | 2/1989 | Walsh et al. | 264/288.4 |
| 4,851,174 | A | | 7/1989 | Lorsch | 264/234 |
| 4,892,689 | A | | 1/1990 | Van Cappellen et al. | 264/25 |
| 4,916,049 | A | * | 4/1990 | Toya | 430/640 |
| 4,994,214 | A | | 2/1991 | Stevens et al. | 264/25 |
| 5,147,768 | A | | 9/1992 | Sakakibara | 430/501 |
| 5,229,246 | A | * | 7/1993 | Shibita et al. | 430/640 |
| 5,252,441 | A | | 10/1993 | James et al. | 430/496 |
| 5,254,445 | A | | 10/1993 | Takamuki et al. | 430/501 |
| 5,254,449 | A | | 10/1993 | James et al. | 430/533 |
| 5,395,743 | A | | 3/1995 | Brick et al. | 430/496 |
| 5,397,826 | A | | 3/1995 | Wexler | 524/356 |
| 5,413,902 | A | | 5/1995 | Hara et al. | 430/505 |
| 5,425,980 | A | | 6/1995 | Grace et al. | 430/532 |
| 5,427,900 | A | | 6/1995 | James et al. | 430/496 |
| 5,432,050 | A | | 7/1995 | James et al. | 430/496 |
| 5,434,037 | A | | 7/1995 | Wexler et al. | 430/496 |
| 5,436,120 | A | | 7/1995 | Wexler et al. | 430/496 |
| 5,549,864 | A | | 8/1996 | Greene et al. | 264/280 |
| 5,585,229 | A | | 12/1996 | Kawamoto et al. | 430/533 |
| 5,629,141 | A | | 5/1997 | Kawamoto | 430/535 |
| 5,719,015 | A | * | 2/1998 | Mihayashi et al. | 430/533 |
| 5,795,512 | A | | 8/1998 | Greener et al. | 264/40.6 |
| 5,965,338 | A | | 10/1999 | Visconte et al. | 430/505 |
| 6,037,108 | A | * | 3/2000 | Chen et al. | 430/349 |
| 6,071,682 | A | | 6/2000 | Greener et al. | 430/533 |

OTHER PUBLICATIONS

Research Disclosure, Nov., 1992, Item 34390, pp. 869–874.
Research Disclosure, Feb., 1995, Item 37038, pp. 79–114.
Research Disclosure, Sep. 1996, Item 38957, pp. 591–639.
International Standard, Refer. No. ISO 18910:2000(E), First Edition May, 15, 2000.

* cited by examiner

*Primary Examiner*—Richard L. Schilling
(74) *Attorney, Agent, or Firm*—Doreen M. Wells

(57) ABSTRACT

A photographic film comprising a base layer and at least one emulsion layer, the emulsion layer having a melting temperature that is within 4 degrees centigrade of the incubation temperature used in an accelerated core-set test.

9 Claims, No Drawings

EMULSION COMPOSITION TO CONTROL FILM CORE-SET

FIELD OF THE INVENTION

The present invention relates to a photographic film with low core-set curl and more particularly to a photographic film comprising an emulsion layer whose composition is modified so as to lower the core-set curl propensity of the film.

BACKGROUND OF THE INVENTION

In many imaging applications excessive film curl can cause serious difficulties with film transport and handling and it is, therefore, important to reduce the core-set propensity of the image-bearing film to meet system specifications. Over the years many approaches have been taken to reduce core-set curl in photographic films. Most approaches are associated with the film base, which normally makes the most significant contribution to the core-set curl produced by the film. These approaches can be generally grouped in terms of five distinct mechanisms: (1) physical aging, (2) inherent curl, (3) ironing, (4) reverse winding, and (5) addition of a restraining layer. Each of these mechanisms is applicable for certain types of films and selection of one over the other depends on the particular circumstances of the problem at hand. Following is a brief summary of these general approaches.

(1) Physical Aging.

This method is practiced by heating the finished film (usually but not always) in a wound state to relatively high temperatures (typically 10 to 40° C. below the glass transition temperature) for relatively long times (typically >1 day) in order to lower the propensity of the film to take up curl in subsequent winding operations. This method changes the relaxation characteristics of the film (an aged film relaxes slower than a fresh film) and is especially useful when the final winding diameter of the film is much less than the diameter during annealing. This approach is discussed in U.S. Pat. Nos. 4,141,735; 5,254,445; 5,629,141 and 5,585,229.

(2) Inherent Curl.

During the manufacture of film support it is possible to induce curl in a given direction by differentially (asymmetrically) heating the film during the stretching step, i.e., by inducing a temperature gradient of ca. 10–15° C. across the thickness of the film as it is stretched above the glass transition temperature. If this inherent curl is in a direction opposite of the expected core-set curl it will compensate to some extent for the curl induced during winding and will yield lower effective curl. This method requires significant modification of the film manufacturing process and fine-tuning the stretching temperature of the material. This approach is considered in U.S. Pat. Nos. 4,892,689 and 4,994,214. The latter combines the inherent curl approach with physical aging; it clearly requires a fundamental change in the film making process as well as storage for long times at relatively high temperatures.

(3) Ironing.

By heating relatively short and narrow film sections to temperatures in the vicinity of Tg it is possible to remove curl induced by core-set. This method requires some tension as the film is conveyed through the heating device and the heated film must be either flat or slightly curved in a direction opposite of the expected core-set curl. Residence times for this heating method are relatively short, of the order of minutes or less. However, this method is not ideally suited for treating wide and long production rolls because of the difficulty of controlling temperature uniformity and the possibility of scratching the film and damaging the coated emulsions within the ironing device. Examples of this approach are discussed in U.S. Pat. Nos. 3,916,022; 4,808,363; 4,851,174 and 5,549,864.

(4) Reverse Winding.

By winding the film in the opposite direction of its induced core-set curl the curl value can be reduced. This can be done in principle at any temperature but the rate of curl change depends on the temperature at which the film is stored and may require very long times to achieve a meaningful reduction in curl at ambient conditions. U.S. Pat. No. 3,806,574 falls under this general category but the way it is proposed in the preferred embodiment is not suitable for use in an on-line production mode since the reverse wound roll must be stored for long times (depending on the original storage time), often greater than one day, to make an effective change in curl. In an attempt to alleviate this problem, U.S. Pat. No. 5,795,512 teaches that a combination of reverse winding and mild heating of the film can effectively reduce core-set curl after relatively short storage times.

(5) Addition of a Restraining Layer.

U.S. Pat. No. 6,071,682 teaches that by coating a thin polymeric layer on the side of the base opposite the emulsion it is possible to reduce the core-set propensity of the base layer provided that the coated layer is sufficiently thick and that the glass transition temperature of the polymeric layer is equal to or greater than that of the base layer.

All of the above approaches involve changes applied to the base layer. In photographic films comprising relatively thick emulsion layers, the contribution of the emulsion layer to film core-set can be appreciable and changes in the composition and structure of this layer can impart significant changes to film core-set.

The present invention discloses that the emulsion layer can be made to affect film core-set. In particular, when the melting point of the emulsion layer is lowered, film set curl is significantly lowered.

The art needs new approaches to this problem, including changes to the emulsion layers, especially when they are relatively thick.

SUMMARY OF THE INVENTION

The core-set curl of photographic films depends largely on the properties of the support layer, but if the emulsion layer is relatively thick (about 10–30 microns), its contribution to film core-set becomes important. In the present invention the emulsion layer is modified so as to reduce its contribution to the overall film core-set. By lowering the melt temperature of the emulsion layer to within 4 degrees C. of the incubation temperature used in the core-set test described herein, the core-set curl of the emulsion layer is significantly reduced thus lowering the overall film core-set. Suppression of the melting point of the emulsion layer can be accomplished, for example, by the addition of a sufficient quantity of a humectant such as glycerol. This approach is feasible only if an accelerated core-set test is applied, that is, if the test involves incubation of the wound film under high temperature to simulate long term storage under extreme environmental conditions.

DETAILED DESCRIPTION OF THE INVENTION

The present invention is a silver halide photographic film comprising a film base bearing at least one emulsion layer with the emulsion layer comprising gelatin as a major component. The method of manufacture of such a film is well known in the art.

When the film is wound on a spool it is likely to take up some core-set curl, the extent of which depends on the diameter of the spool, the duration of winding (storage time) and the storage temperature. If the curl exceeds a certain prescribed limit, the film will likely have poor transport in a camera, or during photographic processing. Because of the tendency to lower the size of film cartridges, hence decrease spool diameter, the problem of maintaining low core-set curl has become more acute. General efforts in this regard have led to the use of a high Tg film base material, e.g., poly (ethylene naphthalate) (PEN), and costly base annealing procedures as described in U.S. Pat. Nos. 4,141,735; 5,254,445; 5,629,141 and 5,585,229. However, in films comprising relatively thick emulsion layers (ratio of emulsion layer thickness, $t_e$, to base layer thickness, $t_b$, >0.15) the emulsion layer can potentially make a significant contribution to film core-set.

The core-set propensity of the film is often measured under extreme conditions to simulate long storage times and adverse environmental conditions—the Accelerated Core-Set Test. Such tests are conducted by winding the film around an actual spool and incubating the film at high temperature for a prescribed time, usually less than 1 day. The wound film is then removed from the oven, allowed to equilibrate for some time at ambient conditions and its curl is measured according to Test Method A in American National Standard Institute (ANSI), P41.29-1985.

In the present invention it is shown that if the incubation temperature used in the core-set test protocol is within 4 degrees C. of melting temperature of the emulsion layer, or conversely, if the melting range of the emulsion layer is reduced such that it overlaps with the incubation temperature, the contribution of the emulsion layer to the core-set curl taken up by the film is substantially lowered, hence the film core-set is decreased. The melting range of the emulsion layer can be measured by the differential scanning calorimetry (DSC) method. According to this method a small sample (5–20 mg) of the emulsion layer is peeled off the film, equilibrated at ambient conditions (50% RH and 21° C.) and sealed in a small aluminum pan. The pan with the sample is then placed in the DSC apparatus (e.g., Perkin Elmer 7 Series Thermal Analysis System) and its thermal response is recorded by scanning at a rate of 10° C./min from room temperature up to 200° C. A distinct endothermic peak recorded by the apparatus within the test interval represents the melting process of the gelatin phase which is the major component of the emulsion layer. The temperature interval corresponding to this peak is the melting range of the emulsion.

The melting range of gelatin can be normally suppressed by the addition of humectants, or water absorbing materials, that are fully miscible in gelatin. The minimum concentration of such additive is dictated by the incubation temperature used in the accelerated core-set test, the higher the temperature the lower the concentration of the corresponding additive. Examples of humectants known to lower the melting point of gelatin are, glycerol, ethylene diurea, monosaccharide and polysaccharides.

The support of the present invention may be treated with corona discharge (CDT), UV, glow discharge (GDT), flame or other such methods that enhance adhesion of the support surface. The preferred method is the glow discharge treatment as described in U.S. Pat. No. 5,425,980 incorporated herein by reference.

The film base of the present invention can contain other components commonly found in film supports for photographic elements. These include dyes, lubricants and particles of organic or inorganic materials such as glass beads, filler particles, magnetic particles and antistatic agents. These are described in more detail in *Research Disclosure,* February 1995, Item 37038, pages 79–114 and *Research Disclosure,* September 1996, Item 38957, pages 591–639. The film base can bear layers commonly found on film support used for photographic elements. These include magnetic layers, subbing layers between other layers and the support, photosensitive layers, interlayers and overcoat layers, as are commonly found in photographic elements. These layers can be applied by techniques known in the art and described in the references cited in Research Disclosure, Item 37038 cited above.

Magnetic layers that can be used in photographic elements of this invention are described in U.S. Pat. Nos. 3,782,947; 4,279,975; 5,147,768; 5,252,441; 5,254,449; 5,395,743; 5,397,826; 5,413,902; 5,427,900; 5,432,050; 5,434,037; 5,436,120; in *Research Disclosure,* November 1992, Item 34390, pages 869. and in Hatsumei Kyonkai Gihou No. 94-6023, published Mar. 15, 1995, by Hatsumei Kyoukai, Japan.

Photographic elements of this invention can have the structure and components shown in *Research Disclosures,* Items 37038 and 38957 cited above and can be imagewise exposed and processed using known techniques and compositions, including those described in the *Research Disclosures* Items 37038 and 38957 cited above.

The following examples further illustrate the invention.

EXAMPLE 1 (COMPARATIVE)

A photographic film support comprising a poly(ethylene naphthalate) (PEN) layer, 86 $\mu$m thick, and an adhesion promoting layer is coated with a gelatin layer at a dry laydown of 2000 mg/ft$^2$ following methods well known to those skilled in the art. The PEN film was previously annealed at 110° C. for 5 days to lower its core-set propensity. The Accelerated Core-Set Test is then performed as follows.

The coated film is wound on a 1-inch-diameter core, emulsion side in, placed in a sealed bag and then incubated at 80° C. for 2 hours. The wound film is removed from the oven and is allowed to equilibrate at 21° C./50% RH for 24 hours. The film is finally unwound from the core and its curl measured in accordance with Test Method A in ANSI P41.29-1985. Similar measurement is repeated for the annealed support layer without the coating. The melting temperature of the coated layer is measured by a differential scanning calorimeter (Perkin-Elmer 7 Series Thermal Analysis System). A few (5–20) mg of the coating is peeled off a section of the support layer that is not treated with an adhesion promoting layer and the sample is sealed in an aluminum pan of the DSC apparatus after being equilibrated at 21° C./50% RH. The DSC is operated by heating the sample at a rate of 10°/min. The peak position of the melting exotherm recorded by the DSC is taken as the melting point ($T_m$) of the sample.

EXAMPLE 2 (COMPARATIVE)

Same as Example 1 except that the gelatin is formulated with 6 wt % of glycerol.

EXAMPLE 3 (COMPARATIVE)

Same as Example 1 except that the gelatin layer is formulated with 9 wt % of glycerol.

EXAMPLE 4

Same as Example 1 except that the gelatin layer is formulated with 12 wt % of glycerol.

EXAMPLE 5

Same as Example 1 except that the gelatin layer is formulated with 15 wt % of glycerol.

EXAMPLE 6 (COMPARATIVE)

Annealed PEN support (same as that described in Example 1) is used having an antistatic layer overcoated with a transparent magnetic layer on the other side. The support is coated on the side opposite to the antistatic layer with the layers having compositions as described in U.S. Pat. No. 5,965,338.

EXAMPLE 7

Same as Example 6 except that the emulsion layers are formulated with 8 wt % of glycerol.

EXAMPLE 8

Same as Example 6 except that the emulsion layers are formulated with 4 wt % of glycerol.

EXAMPLE 9

Same as Example 6 except that the emulsion layers are formulated with 11 wt % of glycerol.

The results for all the Examples are summarized in Table 1.

TABLE 1

| Example | Film Core-Set (1/m) | Support Core-Set (1/m) | Tm (° C.) |
|---|---|---|---|
| 1 (Comparison) | 161 | 94 | 84.7 |
| 2 (Comparison) | 157 | 94 | 86.8 |
| 3 (Comparison) | 156 | 94 | 84.5 |
| 4 (Invention) | 130 | 94 | 83.5 |
| 5 (Invention) | 107 | 94 | 81.1 |
| 6 (Comparison) | 134 | 87 | — |
| 7 (Invention) | 100 | 66 | — |
| 8 (Invention) | 108 | 69 | — |
| 9 (Invention) | 100 | 87 | — |

In Examples 1 to 5, the emulsion layers contain gelatin and the Tm was measured. In Examples 6 to 9, the emulsion layers contain real emulsion and the Tm was difficult to measure The results in Table 1 show that as the melting point of the emulsion layer was decreased to within 5 degrees centigrade of the incubation temperature used in an accelerated core-set test, the core-set curl decreased, which is an advantage.

The invention has been described in detail with particular reference to certain preferred embodiments thereof, but it will be understood that variations and modifications can be effected within the spirit and scope of the invention.

What is claimed is:

1. A photographic film comprising a base layer and at least one emulsion layer, the emulsion layer having a melting temperature that is within 4 degrees centrigrade of the incubation temperature used in a standard accelerated core-set test;

wherein the ratio of emulsion layer thickness, $t_e$, to base layer thickness, $t_b$, $\leqq 0.15$; and wherein the incubation temperature in the standard accelerated core-set test is about 80° C.

2. A photographic film comprising a base layer and at least one emulsion layer, the emulsion layer containing a humectant at a concentration sufficient to suppress the melting temperature as measured by differential scanning calorimetry, at a temperature that is within 4 degrees centrigrade of the incubation temperature used in a standard accelerated core-set test;

wherein the ratio of emulsion layer thickness, $t_e$, to base layer thickness, $t_b$, $\leqq 0.15$; and wherein the incubation temperature in the standard accelerated core-set test is about 80° C.

3. The photographic film of claim 2 wherein the humectant is glycerol, ethylene diurea, a polysaccharide or a monosaccharide.

4. The photographic film of claim 1 or 2 further comprising at least one backing layer.

5. The photographic film of claim 1 or 2 wherein the base layer comprises a polyester film.

6. The photographic film of claim 5 wherein the polyester is selected from poly(ethylene terephthalate) and poly (ethylene naphthalate).

7. The photographic film of claim 1 or 2 having a base layer that is annealed at temperatures from Tg of the material in the base layer to that Tg-50° C. for a period of 0.01 to 1000.00 hours.

8. The photographic film of claim 1 or 2 wherein the melting temperature of the emulsion layer is within 3° C. of the incubation temperature used in the core-set test.

9. A method of reducing the core set of an imaging film, comprising:

a) providing a film with an emulsion layer and a base layer, wherein the ratio of emulsion layer thickness, $t_e$; to base layer thickness, $t_b$; $\leqq 0.15$;

b) winding the film on a core;

c) incubating the wound film at about 80° C. for about 2 hours;

d) terminating the incubation and equilibrating the film at ambient temperature;

e) measuring the core set; and f) lowering the core set by adjusting the melt temperature of the emulsion layer to within 4° C. of the temperature during incubation.

* * * * *